US012030705B2

(12) United States Patent
Oh et al.

(10) Patent No.: US 12,030,705 B2
(45) Date of Patent: Jul. 9, 2024

(54) POUCH ASSEMBLY AND CONTAINER DEVICE USING SAME

(71) Applicant: INNERBOTTLE CO., LTD., Seongnam-si (KR)

(72) Inventors: Sea Il Oh, Suwon-si (KR); Yo Kyung Jang, Siheung-si (KR)

(73) Assignee: INNERBOTTLE CO., LTD., Seongnam-si (KR)

( * ) Notice: Subject to any disclaimer, the term of this patent is extended or adjusted under 35 U.S.C. 154(b) by 384 days.

(21) Appl. No.: 17/382,854

(22) Filed: Jul. 22, 2021

(65) Prior Publication Data

US 2022/0041360 A1 Feb. 10, 2022

Related U.S. Application Data

(63) Continuation of application No. PCT/KR2020/000850, filed on Jan. 17, 2020.

(30) Foreign Application Priority Data

Jan. 22, 2019 (KR) ..... 10-2019-0008001

(51) Int. Cl.
*B65D 77/06* (2006.01)
*B65D 75/58* (2006.01)

(52) U.S. Cl.
CPC ..... *B65D 77/06* (2013.01); *B65D 75/58* (2013.01)

(58) Field of Classification Search
CPC .... B65D 77/06; B65D 75/58; B65D 51/1622; B65D 83/0061; B65D 77/065;
(Continued)

(56) References Cited

U.S. PATENT DOCUMENTS 8,397,958 B2 * 3/2013 Smith ..... B65D 75/5877 222/105
8,844,767 B1 * 9/2014 Bates ..... B65D 47/2031
(Continued)

FOREIGN PATENT DOCUMENTS

CN 105217189 A 1/2016
CN 107585732 A 1/2018
(Continued)

OTHER PUBLICATIONS

Hwang, Chanyoon, International Search Report, dated Apr. 28, 2020, Korean Intellectual Property Office.

*Primary Examiner* — Donnell A Long
(74) *Attorney, Agent, or Firm* — Sisson & Banyas, Attorneys at Law, LLC

(57) ABSTRACT

The present disclosure relates to a pouch assembly for storing a liquid and a container device using the same. A pouch assembly according to an embodiment of the present disclosure includes a pouch unit which is formed of an elastic material and in which a charging space for charging the liquid is formed. The pouch unit includes a pouch unit body in which the charging space and a pouch-side opening communicating with the charging space on one side thereof are formed, a pouch-side catch which is formed on one side of the pouch unit body and in which an outer circumferential side thereof in a state in which the pouch-side catch surrounds the pouch-side opening further extends outward from an outer surface side of the pouch unit body, and a selective sealing unit which is disposed at an upper side of the pouch-side catch and selectively opens/closes the pouch-side opening.

19 Claims, 20 Drawing Sheets

(58) Field of Classification Search
CPC ..... B65D 75/5861; B65D 83/0094; B65B 39/12; B65B 3/18; B65B 3/04
See application file for complete search history.

(56) References Cited

U.S. PATENT DOCUMENTS

| | | | | |
|---|---|---|---|---|
| 2002/0130139 | A1* | 9/2002 | Shiraishi | B65D 23/02 222/105 |
| 2010/0276456 | A1* | 11/2010 | Corbin | B05B 11/1028 222/207 |
| 2011/0024429 | A1* | 2/2011 | Vanhove | B65D 51/1661 220/495.01 |
| 2012/0187158 | A1* | 7/2012 | Pritchard | B65D 47/2031 222/494 |
| 2014/0209644 | A1* | 7/2014 | Socier | B65D 47/2031 222/494 |
| 2015/0175399 | A1* | 6/2015 | Witte | B29C 49/20 264/516 |

FOREIGN PATENT DOCUMENTS

| | | | | |
|---|---|---|---|---|
| EP | 2832658 | A1 | 2/2015 | |
| GB | 2209056 | A * | 4/1989 | B65D 83/0061 |
| JP | H10-81354 | A | 3/1998 | |
| JP | H11-282236 | A | 10/1999 | |
| KR | 20-0209523 | Y1 | 1/2001 | |
| KR | 10-2010-0136183 | A | 12/2010 | |
| KR | 10-1288797 | B1 | 7/2013 | |
| KR | 10-2018-0124430 | A | 11/2018 | |

* cited by examiner

[FIG. 1A]
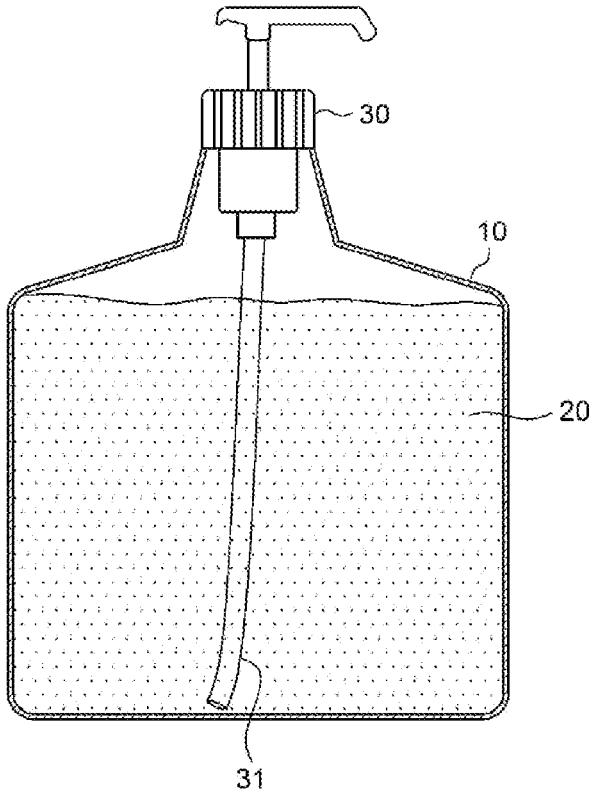

[FIG. 1B]
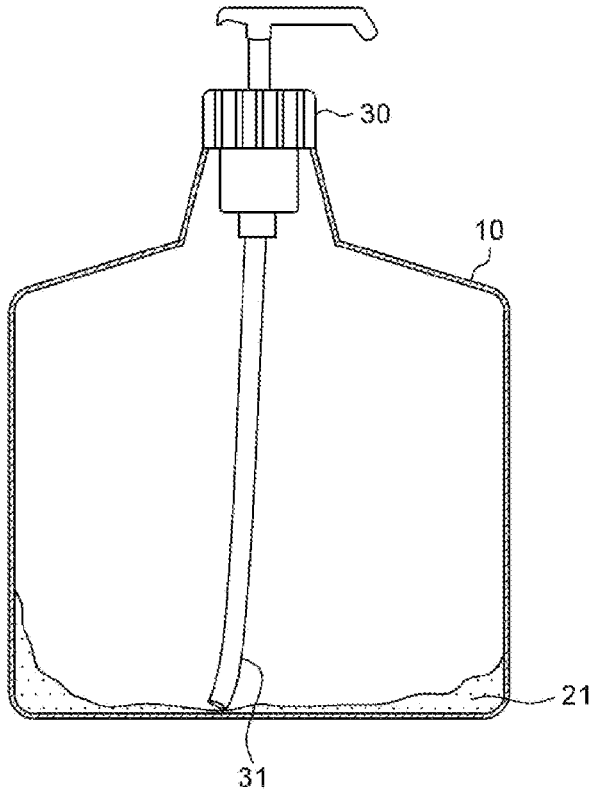

[FIG. 2A]
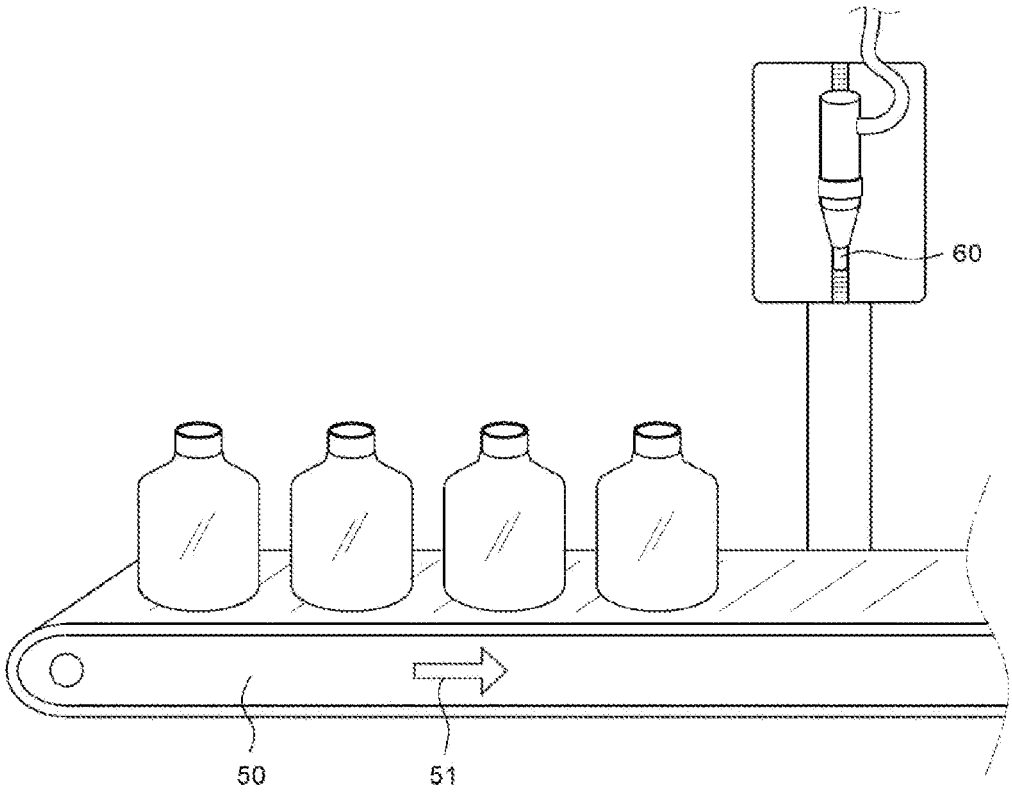

[FIG. 2B]
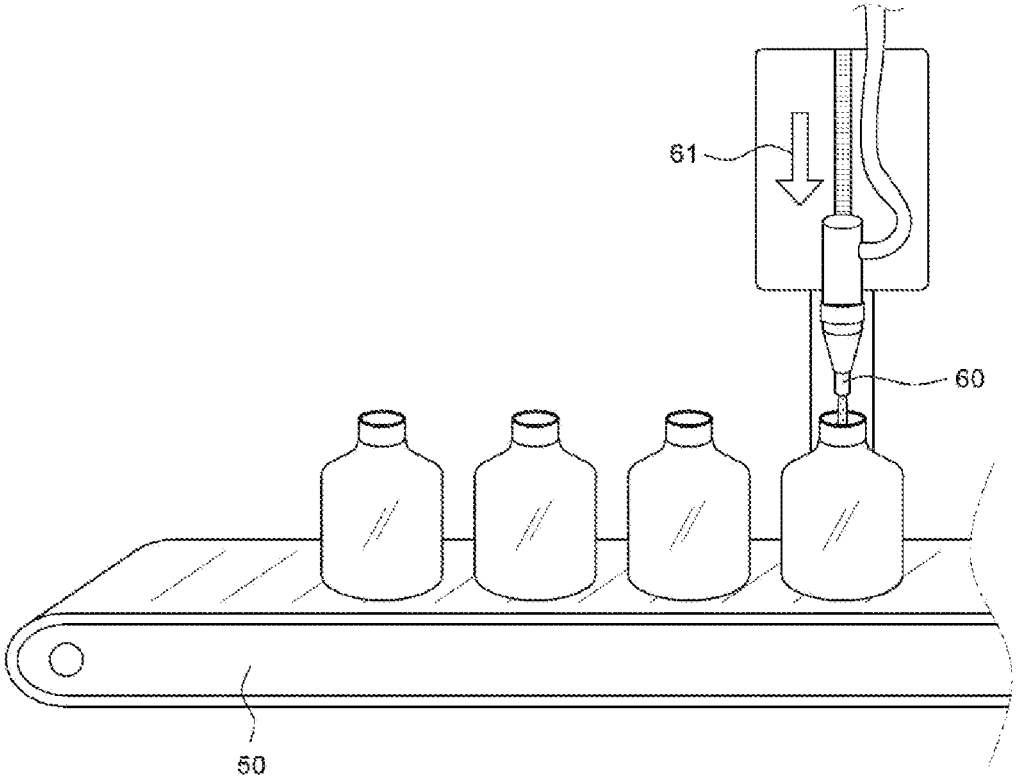

[FIG. 3]
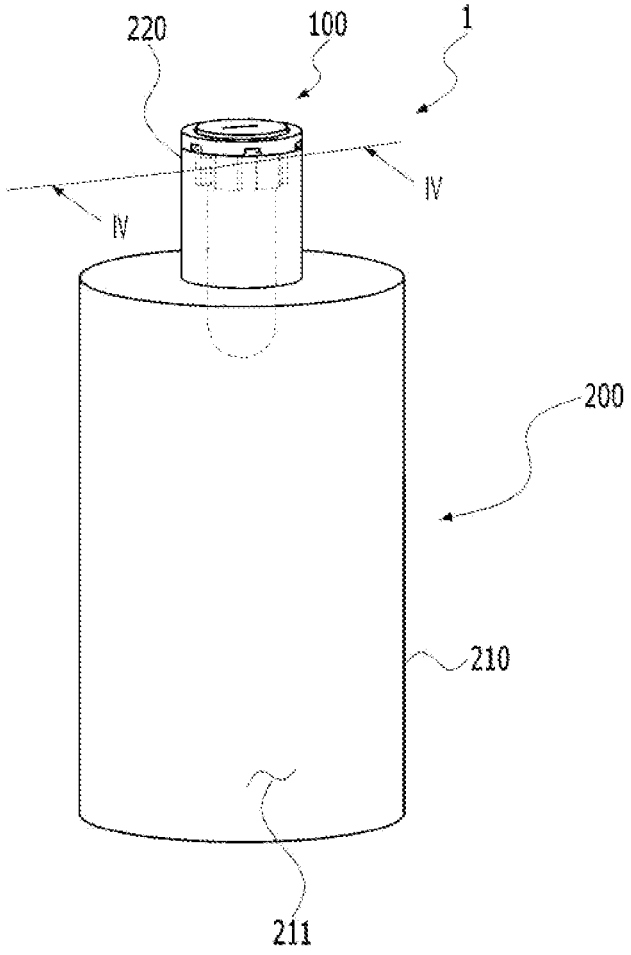

[FIG. 4]
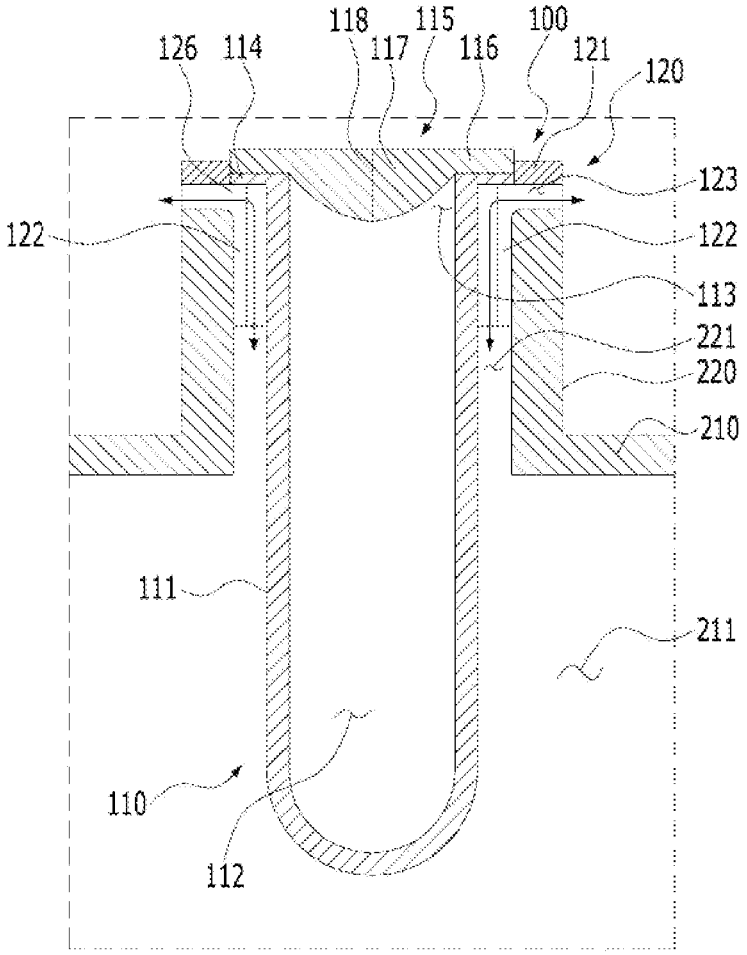

[FIG. 5]
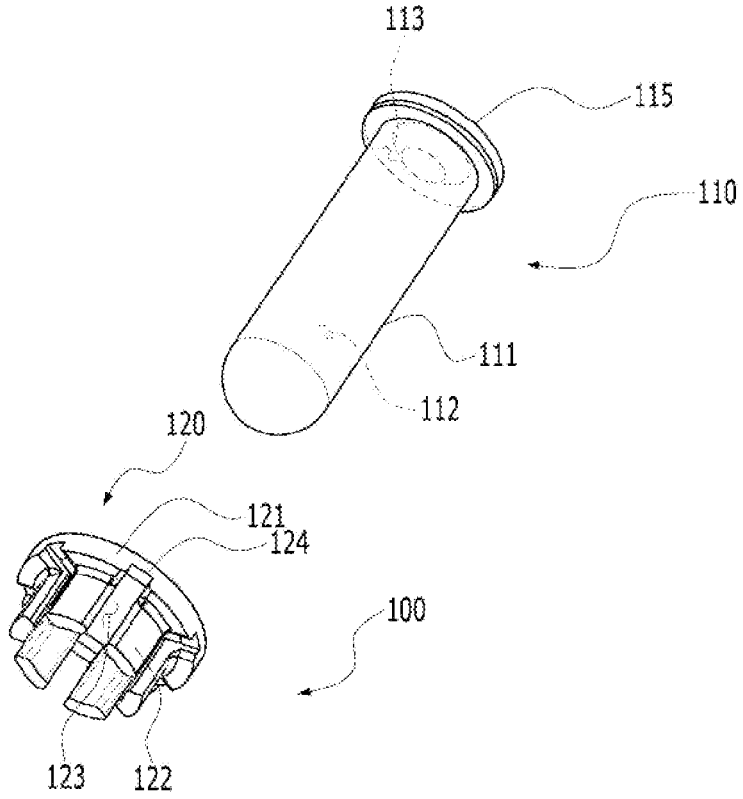

[FIG. 6]
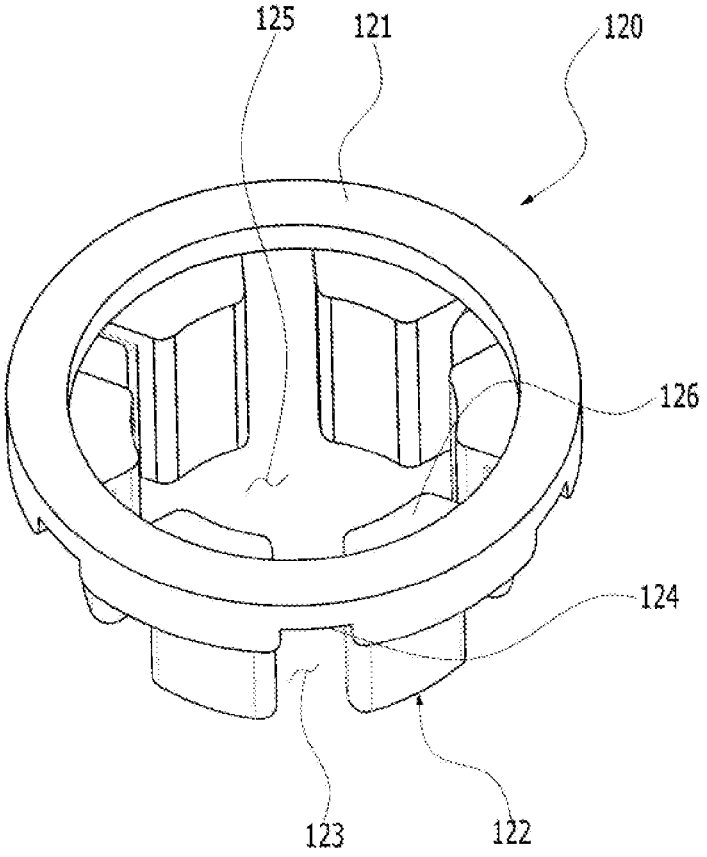

[FIG. 7]
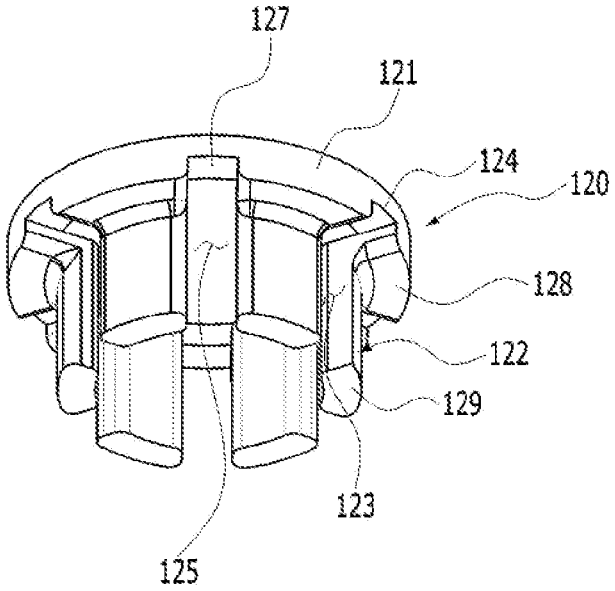

[FIG. 8]
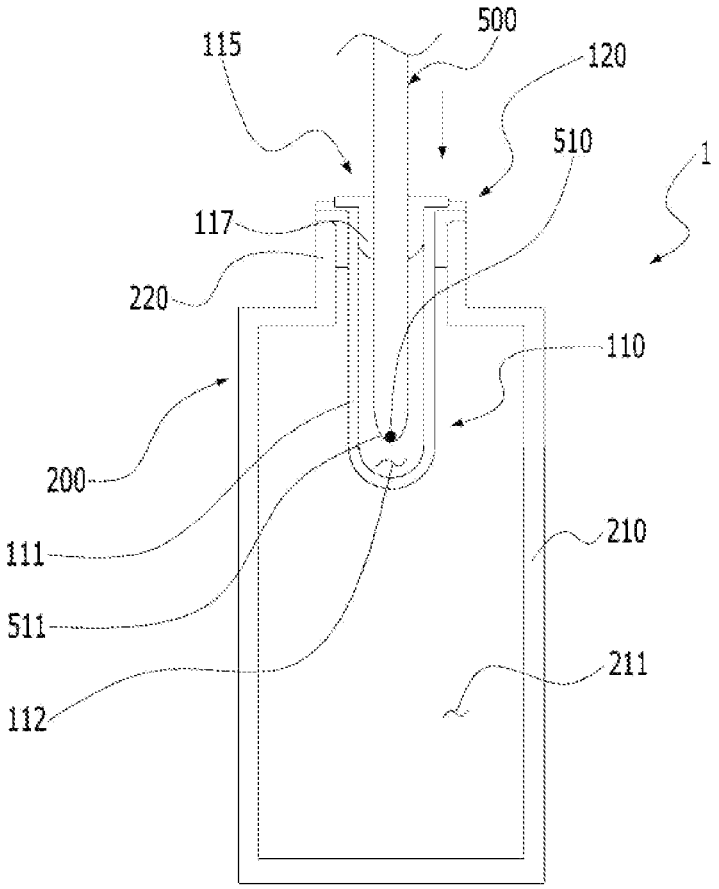

[FIG. 9]
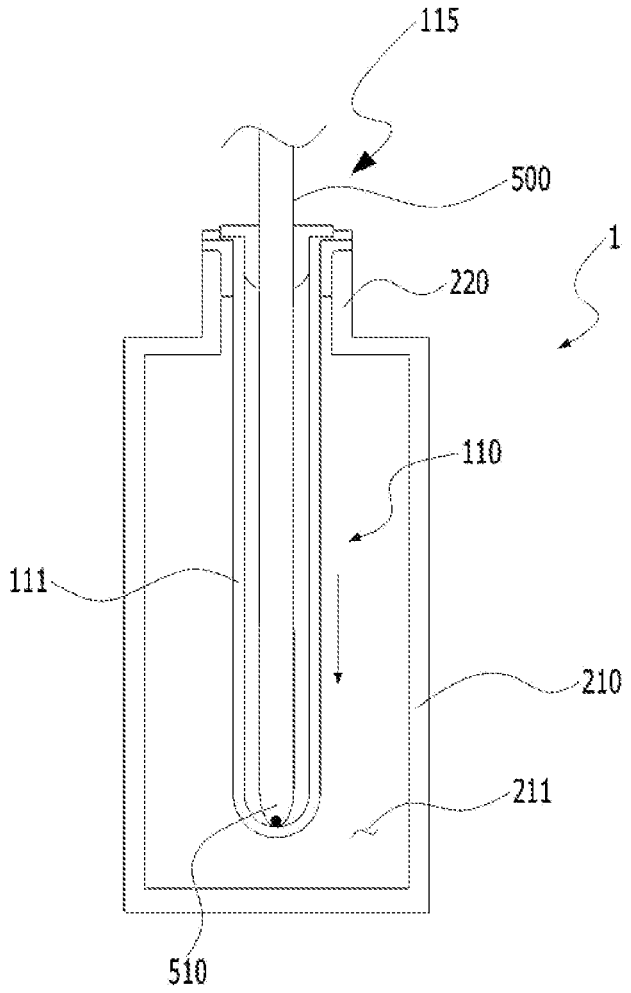

[FIG. 10]
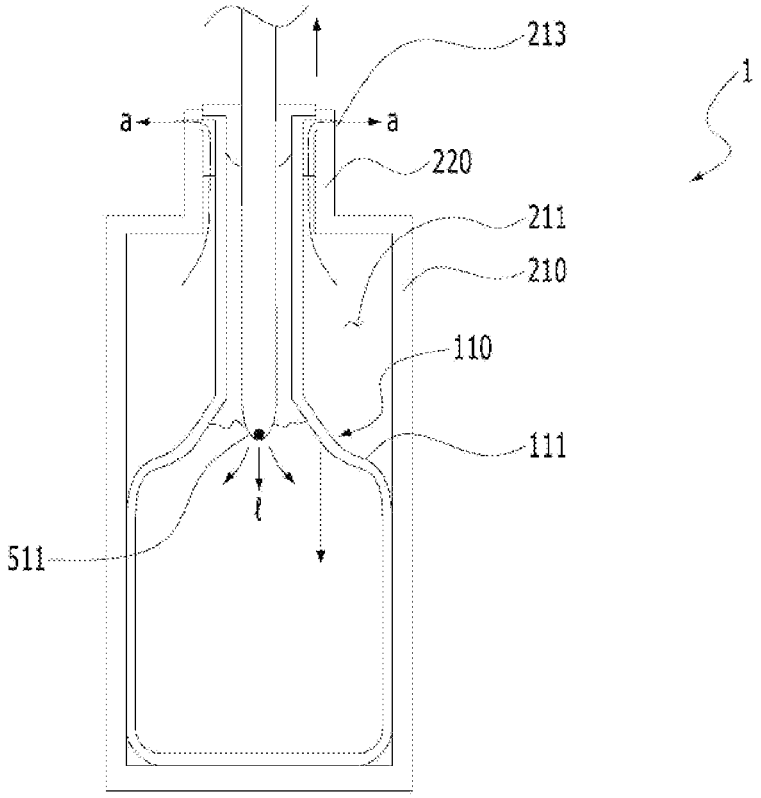

[FIG. 11]
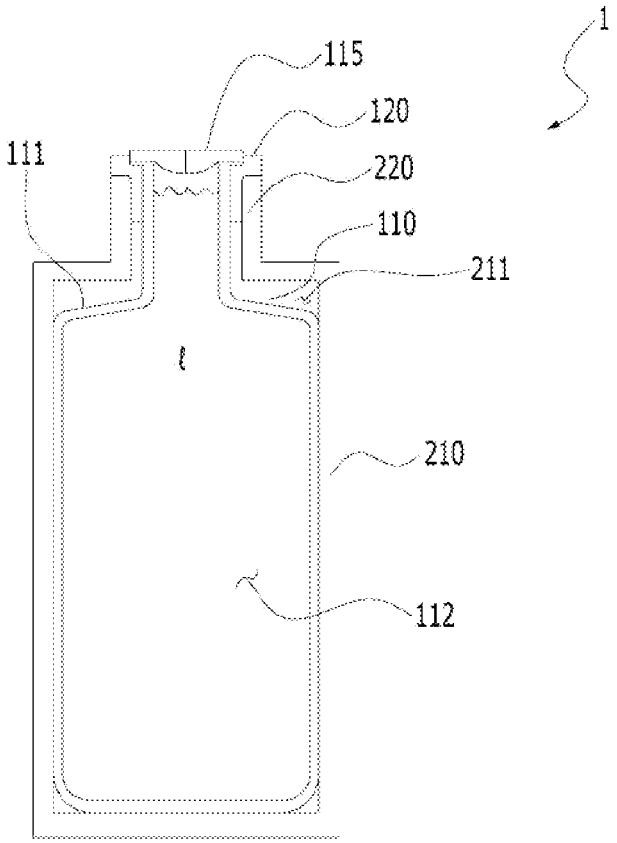

[FIG. 12]
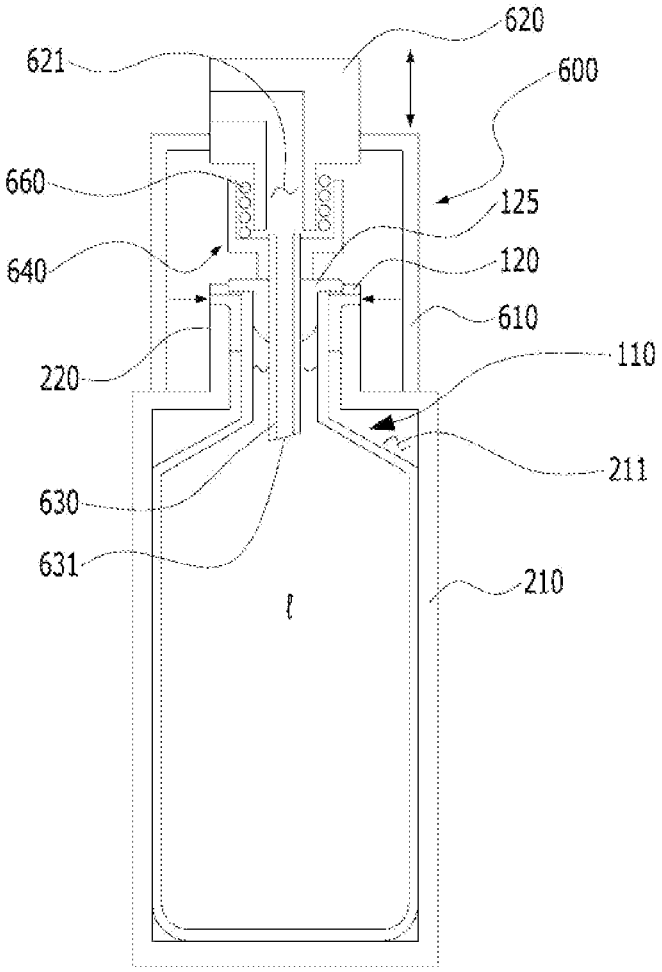

[FIG. 13]
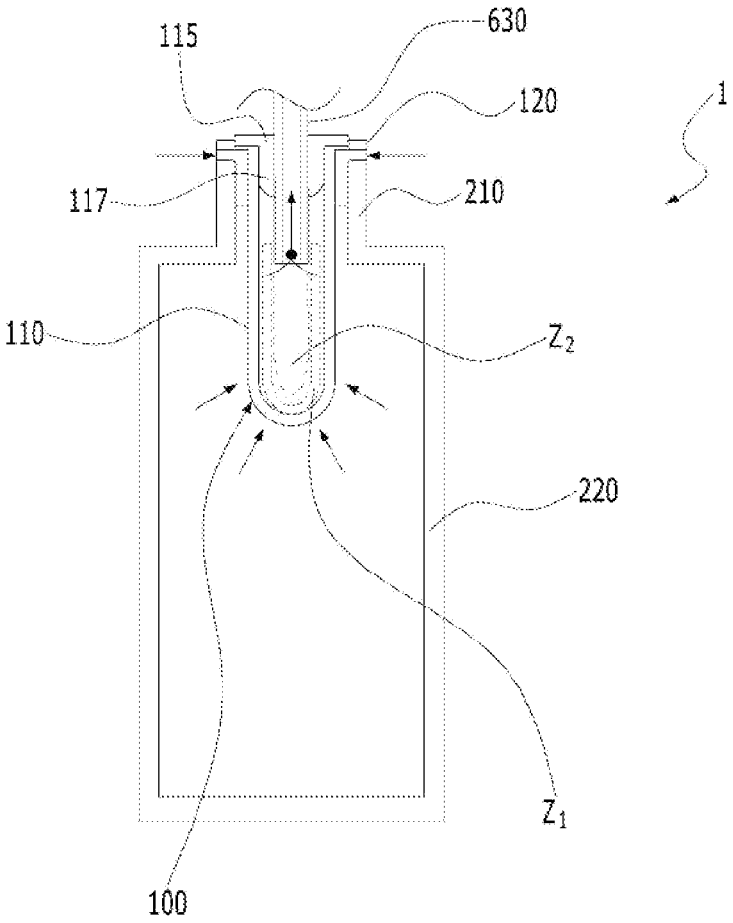

[FIG. 14]
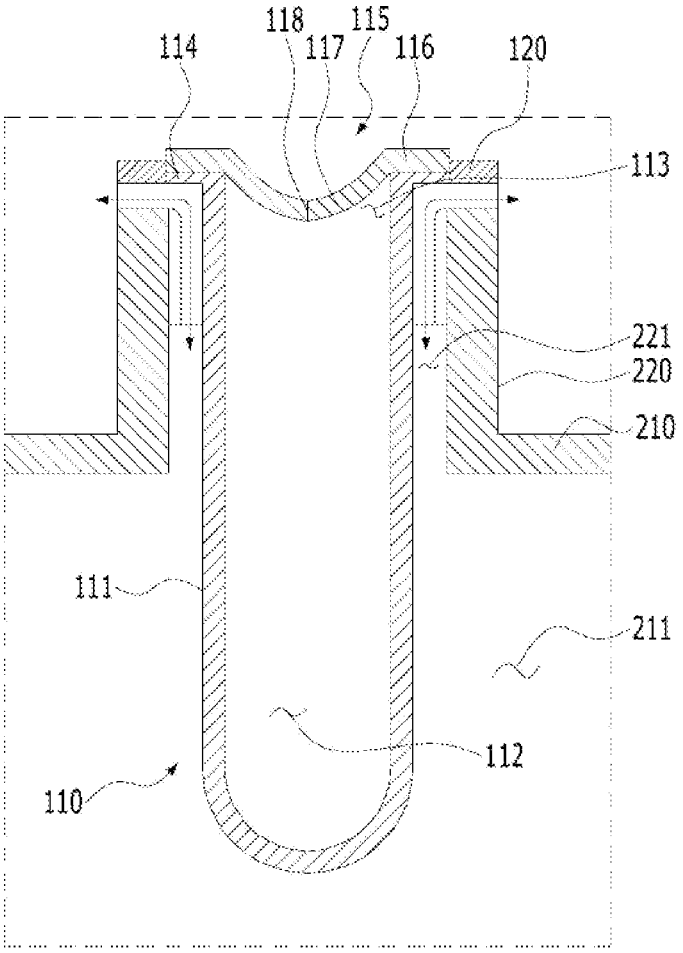

[FIG. 15]
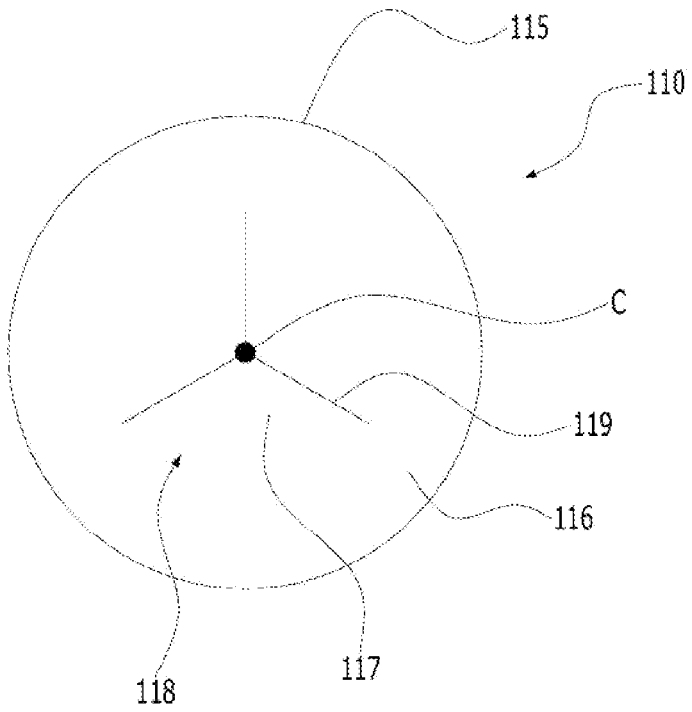

[FIG. 16]
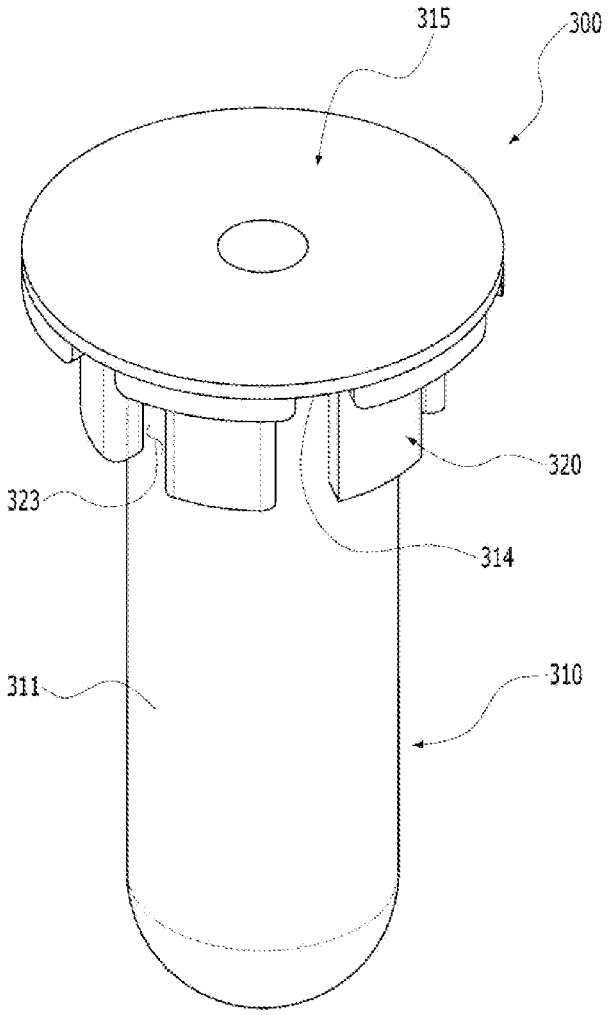

[FIG. 17]
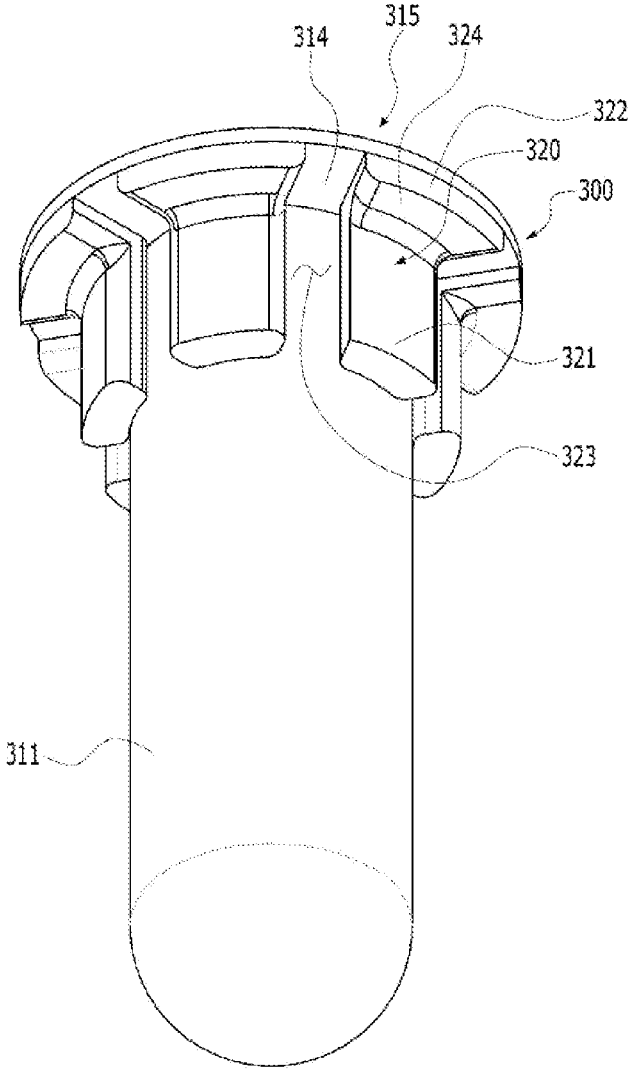

[FIG. 18]
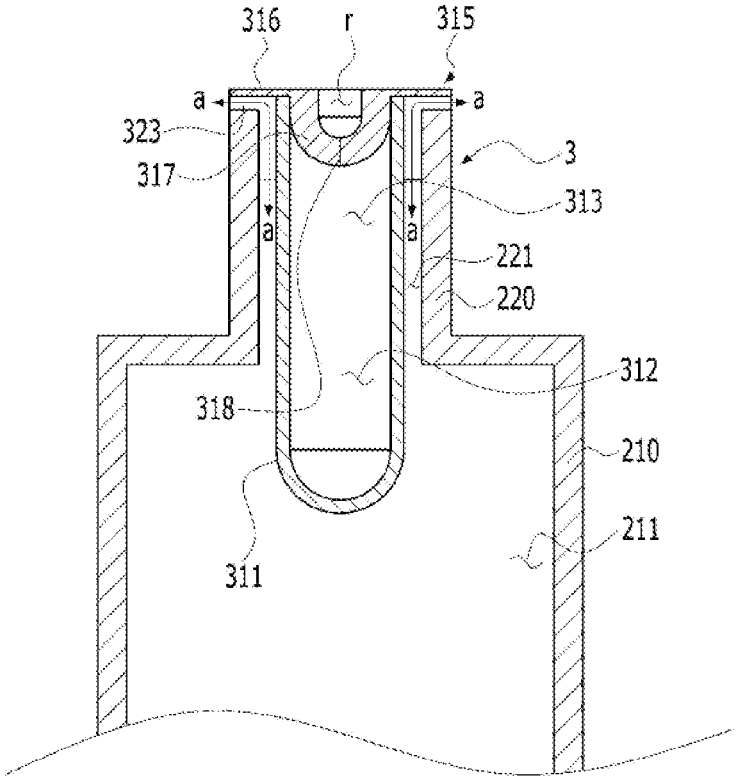

POUCH ASSEMBLY AND CONTAINER DEVICE USING SAME

PRIORITIES AND CROSS REFERENCES

This application claims priority from International Application No. PCT/KR2020/000850 filed on 17 Jan. 2020 which claims priority South Korean Application No. 10-2019-0008001 filed on 22 Jan. 2019, the teachings of each of which are incorporated by reference herein in their entirety.

TECHNICAL FIELD

The present disclosure relates to a pouch assembly for storing a liquid and a container using the same, and more particularly, to a pouch assembly capable of storing and discharging a liquid that allows a content to be wholly used, and a container device using the same.

BACKGROUND ART

FIG. 1A illustrates a storage container of a viscous liquid content according to the background art.

Liquids such as shampoos, lotions, or the like have a characteristic that they have relatively high viscosity. When this high-viscosity content 20 is stored in a container 10, the content tends to stick to an inner wall of the container due to the viscosity thereof. However, due to reasons of beauty, convenience of use, and so on, these goods are generally sold after being stored in the hard container 10 having a relatively small opening, as illustrated in FIG. 1A. That is, most of the contents are produced after stored in the hard container as illustrated in FIG. 1A due to sensibility of consumers, convenience of use, or the like. To discharge the content, a method of coupling a pump to a discharge unit for the convenience of use and suctioning and discharging the content through a discharge pipe due to a pump action based on a pneumatic pressure is generally used. However, there is no problem when the content 20 is sufficient in a storage space of the container 10 and can be discharged through the discharge pipe. However, when the content is a little left in the container 10, this causes a problem in that the remaining content sticks to the inner wall of the container and is not well separated, and the remaining content is hardly discharged. This serves as a great obstacle in cleanly using the contents such as shampoos, lotions, or the like.

FIG. 1B illustrates a state in a storage container when a little content remains in the storage container of a viscous liquid content according to the background art.

As illustrated in FIG. 1B, when a quantity of a remaining content 210 is little, the remaining content 210 sticks to the inner wall of the container 100 and is not well separated from the container 100, and a region in which a discharge pipe 310 coupled to a pump can be suctioned is restricted. Thus, there is a problem in that the remaining content 210 in the container is not effectively discharged. This problem causes the following serious problems because a lot of content sticking to the inner wall of the container is not satisfactorily discharged, which makes use difficult.

First, the content is left at a portion with which no hand comes into contact in the hard container and is discarded without sufficient use, thereby promoting over consumption.

Second, when the container is discarded in a state in which the content such as a lotion, a shampoo, a detergent, or the like is left, environmental pollution can be caused.

Third, when a discharge port is opened by separating a discharge unit such as a pump from the container in order to use the content remaining in the container without being discharged by the discharge unit, the content may be contaminated due to, for instance, inflow of foreign materials.

Fourth, when an attempt is made to discharge the content remaining in the container by separating the discharge unit from the container and reversing and shaking the container, it is difficult to discharge an accurate quantity of content to be used.

Fifth, when the inside of an external container is stained with a remaining content, it is very difficult to recycle or reuse the container.

Meanwhile, to solve the above problems, an airless container in which a lower plate thereof is raised depending on use of a content and a volume of the content is reduced has been introduced. However, this container is unsuitable for a large capacity because the lower plate of the container is raised by a reduction in pressure of the content, and only a cylindrical container can be implemented, which imposes great restrictions on a degree of freedom of container design and increases costs for producing the container.

Therefore, a container and method that allow production at a low cost and can effectively inject and discharge a viscous content while maintaining beauty and convenience due to use of a hard container are required.

DISCLOSURE

Technical Problem

The inventors of the present disclosure have recognize a problem that, when a liquid, especially a high-viscosity liquid, is stored in a hard container having a narrow opening, the liquid content sticks to an inner wall of the hard container due to viscosity and surface tension of the liquid content, and when a little liquid content remains, it is not easily discharged using a pump or the like, which is unuseful. Nevertheless, the inventors have sufficiently recognized voices of related industrial fields in which the hard container is inevitably used for various reasons that the hard container makes a product look elegant in view of appearance, it is necessary to couple a pump or the like to a discharge unit for convenience of use, and so on.

Therefore, the inventors of the present disclosure have devised a container and apparatus in which a pouch having elasticity (an elastic pouch) is housed in a hard container and a liquid content is stored in the elastic pouch, whereby despite using the hard container, the content stored in the hard container can be used safely and perfectly through a new innovative method.

In this regard, as introduced above, the elastic pouch is provided in the hard container, and a process of charging a content in the elastic pouch in a process of producing a product should be accompanied to easily discharge the content even if a little content remains.

FIGS. 2A and 2B illustrate a process of charging liquids in hard containers in a common producing process for a shampoo, a lotion, and so on.

As illustrated in FIG. 2A, in the case of sold products in which liquids such as a shampoo or a lotion are stored in hard containers, the hard containers are disposed on a transfer apparatus 500 in a row and are transferred to a content charging facility 510. The content charging facility may have one or more nozzles 600 according to a design.

However, as illustrated in FIG. 2, because an elastic pouch should be extended for charging in advance, there is a problem that air in an external container should be removed in advance, and there is a problem that foreign materials may flow into the extended elastic pouch while the elastic pouch is charged with a content.

In addition, there is a problem that a hole should be drilled in the external container in order to remove air in the external container, and there is a problem that, after the elastic pouch is extended, the elastic pouch should be sealed for preventing outflow of air or should maintain a reduced pressure in order to maintain the extended state of the elastic pouch for charging.

Therefore, a problem to be solved by the present disclosure is to provide an apparatus, a container, and a method of producing the same, capable of wholly using a content by enabling a viscous liquid to be stored in a container device that can store and discharge a liquid according to the present disclosure.

Another problem to be solved by the present disclosure is to provide an apparatus, a container, and a method of producing the same, in which an elastic pouch that can be inserted into a hard container is provided, a remaining content can be effectively used by a pressure under which the elastic pouch pushes a content toward an opening by a surface area reducing effect caused by shrinkage of the elastic pouch and elasticity (a restoring force) of the elastic pouch, and a discharge pressure of a discharge apparatus, and when the elastic pouch is expanded by the elasticity thereof, the hard container can be deformed in various shapes, and thereby the hard container can be designed regardless of a shape of the hard container.

Yet another problem to be solved by the present disclosure is to provide an apparatus, container, and method of producing the same, capable of hygienically and efficiently charging a content in an elastic pouch while satisfying a condition in which the elastic pouch should be expanded as large as a size of an external container in order to inject the content.

The problems of the present disclosure are not limited to the above-mentioned problems, and other problems not mentioned can be clearly understood by those skilled in the art from the following description.

Technical Solution

A pouch assembly for storing a liquid according to an aspect of an embodiment of the present disclosure includes a pouch unit which is formed of an elastic material and in which a charging space for charging the liquid is formed. The pouch unit includes a pouch unit body in which the charging space and a pouch-side opening communicating with the charging space on one side thereof are formed, a pouch-side catch which is formed on one side of the pouch unit body and in which an outer circumferential side thereof in a state in which the pouch-side catch surrounds the pouch-side opening further extends outward from an outer surface side of the pouch unit body, and a selective sealing unit which is disposed at an upper side of the pouch-side catch and selectively opens/closes the pouch-side opening.

Further, the selective sealing unit may include a sealing unit body which completely covers the pouch-side opening, and a selective sealing unit edge which is provided outside the sealing unit body and is fixed to an upper surface of the pouch-side catch in a state placed on the pouch-side catch, and the sealing unit body may be formed of an elastic material and may enable opening/closing on the basis of a slit formed in the sealing unit body.

Further, a lower surface of the sealing unit body may be formed to protrude toward the pouch-side opening.

Further, the lower surface of the sealing unit body may be formed to protrude in a round shape.

Further, a thickness of the sealing unit body may be continuously increased from an edge of the sealing unit body toward the center of the sealing unit body.

Further, an upper surface of the sealing unit body may be depressed toward the lower surface of the sealing unit body.

Further, the slit may be formed in a single line disposed in the center of the sealing unit body.

Further, the slit may be disposed in the center of the sealing unit body and include two or more lines that are radially disposed from the center of the sealing unit body.

Further, the pouch assembly may further include a guide unit into which the pouch unit body is fitted and in which a lower surface of the pouch-side catch of the pouch unit is placed on an upper side thereof.

Further, the guide unit may include a through-hole which is formed in an annular shape, is disposed in the center of the guide unit, and through which the pouch unit body passes, and fluid channels which are disposed on an outer side of the guide unit relative to the through-hole and some of which are formed in a direction parallel to the through-hole.

Further, the guide unit may include a guide unit body that surrounds the through-hole and is formed in an annular shape, and an insertion section that surrounds the through-hole, is connected with a lower surface of the guide unit body, and includes a plurality of insertion units spaced apart from each other. An inner diameter of the guide unit body may be larger than that of the through-hole, and an outer diameter of the guide unit body may be formed to further extend from outer surfaces of the insertion units toward the outside of the guide unit. The insertion units of the insertion section may be formed to extend in a direction in which the through-hole is formed, a part of an upper surface of each insertion unit may be exposed to the outside through the through-hole, and a lower surface of the pouch-side catch of the pouch unit may be placed on the exposed part of the upper surface of each insertion unit. Some of the fluid channels may be disposed between the insertion units.

Further, one side of each fluid channel may be disposed parallel to a lower end of each insertion unit, and the other side of each fluid channel may be disposed on an outer circumferential surface of the guide unit body. Each fluid channel may be formed in a shape bent from one side of each fluid channel toward the other side of each fluid channel.

Further, the pouch assembly may further include a plurality of guides that are disposed on an outer circumferential surface of the pouch unit body and are formed to protrude in a radial shape. Each guide may include a first region that comes into contact with an outer circumferential surface of the pouch unit body, and a second region that is formed in a shape bent from the first region and is disposed on a lower surface of the pouch-side catch, and each fluid channel formed along an outer surface of the pouch unit body and a lower surface of the pouch-side catch may be disposed between one guide and the neighboring other guide.

Further, horizontal cross sections of the first region and the second region may be formed to have curvatures corresponding to those of the pouch unit body and the pouch-side catch, and the first region and the second region may be formed in a shape bent from each other. A stress distribution part formed slantly may be disposed at a portion at which the first region and the second region are mutually connected.

A container device according to another aspect of an embodiment of the present disclosure includes: an external container in which a storage space is formed and which includes a container-side opening communicating with the storage space; and a pouch unit which is formed of an elastic material and in which a charging space for charging the liquid is formed, the pouch unit including a pouch assembly, a part of which is inserted into the storage space through the container-side opening. The pouch unit includes a pouch unit body in which the charging space and a pouch-side opening communicating with the charging space on one side thereof are formed, a pouch-side catch which is formed on one side of the pouch unit body and in which an outer circumferential side thereof in a state in which the pouch-side catch surrounds the pouch-side opening further extends outward from an outer surface side of the pouch unit body, and a selective sealing unit which is disposed at an upper side of the pouch-side catch and selectively opens/closes the pouch-side opening, and the pouch-side catch and the selective sealing unit are disposed adjacent to the container-side opening.

Further, the selective sealing unit may include a sealing unit body which completely covers the pouch-side opening, and a selective sealing unit edge which is provided outside the sealing unit body and is fixed to an upper surface of the pouch-side catch in a state placed on the pouch-side catch, and the sealing unit body may be formed of an elastic material and enable opening/closing on the basis of a slit formed in the sealing unit body.

Further, the container device may further include a pump unit configured to discharge a liquid content charged in the charging space to the outside. A part of a pumping pipe of the pump unit passes through the slit of the sealing unit and is disposed in the charging space, and the pouch unit may have a pouch contact region with which the inner surface of the pouch unit body comes into contact in a state in which parts of an inner surface of the pouch unit body come into contact therewith and which is formed around the center of the pouch unit body, and a pouch non-contact region which is formed outside the pouch contact region and with which the inner surface of the pouch unit body does not come into contact. The pumping pipe may communicate with the pouch non-contact region.

Further, the pouch assembly may further include a guide unit which the pouch unit body approaches and in which a lower surface of the pouch-side catch of the pouch unit is placed on an upper side thereof. The guide unit may include a through-hole which is formed in an annular shape and in which the pouch unit body passes through the center thereof, and fluid channels which are disposed on an outer side of the guide unit relative to the through-hole and some of which are formed in a direction parallel to the through-hole, and one sides and the other sides of the fluid channels, which communicate with one another, may communicate with the container-side storage space and the outside of the external container, and thus the fluid channels cause the container-side storage space and the outside of the external container to communicate with each other.

Further, the pouch unit body may be formed to extend long in a top-down direction. When a liquid content is stored in the charging space of the pouch unit body, in comparison with a state in which a separate pressure is not applied to the pouch unit body, a top-down length of the pouch unit body may be increased from 150% to 1000%, and a left-right width of the pouch unit body may be increasable from 150% to 1000%.

Further, in a state in which the liquid content is charged in the pouch unit body, a restoring force of the pouch unit body may be greater than a load of the liquid content. In a state in which a slit is closed, the selective sealing unit may inhibit the liquid content from being discharged to the outside through the pouch-side opening of the pouch unit.

Further, the container device may further include a plurality of guides that are disposed on an outer circumferential surface of the pouch unit body and are formed to protrude in a radial shape. Each guide may include a first region that comes into contact with an outer circumferential surface of the pouch unit body, and a second region that is formed to be bent from the first region and is disposed on a lower surface of the pouch-side catch, and each fluid channel, which is formed along an outer surface of the pouch unit body and a lower surface of the pouch-side catch and provides communication between the storage space of the external container and an external space of the external container, may be disposed between one guide and the neighboring other guide.

Further, horizontal cross sections of the first region and the second region may be formed to have curvatures corresponding to those of the pouch unit body and the pouch-side catch, and the first region and the second region may be formed in a shape bent from each other. A stress distribution part formed slantly may be disposed at a portion at which the first region and the second region are mutually connected, and the stress distribution part may come into contact with an edge of the container-side opening of the external container.

Advantageous Effects

The present disclosure is to solve the above problems, and the container device according to the present disclosure is configured to be able to store a viscous liquid, and has an effect of providing an apparatus, a container, and a method of producing the same, capable of wholly using a content.

An apparatus, a container, and a method of producing the same according to an embodiment of the present disclosure provide an elastic pouch that can be inserted into a hard container, in which a remaining content can be effectively used by a pressure under which the elastic pouch pushes a content toward an opening by a surface area reducing effect caused by shrinkage of the elastic pouch and elasticity (a restoring force) of the elastic pouch, and a discharge pressure of a discharge apparatus, and when the elastic pouch is expanded by the elasticity thereof, the hard container can be deformed in various shapes, and thereby the container can be designed regardless of a shape of the hard container.

An apparatus, a container, and a method of producing the same according to an embodiment of the present disclosure can hygienically and efficiently charge a content in an elastic pouch while satisfying a condition in which the elastic pouch should be expanded as large as a size of an external container in order to inject the content.

DESCRIPTION OF DRAWINGS

FIG. 1A illustrates a storage container of a viscous liquid content according to the background art.

FIG. 1B illustrates a state in a storage container when a little remaining content remains in the storage container of a viscous liquid content according to the background art.

FIG. 2A illustrates a process of charging liquids in hard containers in a common producing process for a shampoo, a lotion, and so on.

FIG. 2B illustrates a process of charging liquids in hard containers in a common producing process for a shampoo, a lotion, and so on.

FIG. 3 is a diagram illustrating a container according to an embodiment of the present.

FIG. 4 is a diagram illustrating a cross section taken along line IV-IV of FIG. 3.

FIG. 5 is a diagram illustrating the pouch assembly of FIG. 3.

FIGS. 6 and 7 are diagrams illustrating a configuration of the guide unit of FIG. 5.

FIGS. 8 to 11 are diagrams illustrating a process of charging the container of FIG. 3 with a liquid content.

FIGS. 12 and 13 are diagrams illustrating a process of discharging the liquid content to the outside in a state in which the container of FIG. 3 is charged with the liquid content.

FIG. 14 is a diagram illustrating a part of a cross section of a container according to another embodiment of the present disclosure.

FIG. 15 is a diagram illustrating a pouch unit of a container according to another embodiment of the present disclosure.

FIGS. 16 and 17 are diagrams illustrating a pouch assembly of a container device according to another embodiment of the present disclosure.

FIG. 18 is a diagram illustrating a cross section in a state in which the pouch assembly of FIG. 16 is installed on an external container.

BEST MODE

Advantages and features of the present disclosure and methods of achieving the advantages and features will be clear with reference to exemplary embodiments to be described in detail below together with the accompanying drawings. However, the present disclosure is not limited to the exemplary embodiments disclosed herein but will be implemented in various forms. The exemplary embodiments of the present disclosure are provided so that the present disclosure is completely disclosed, and a person with ordinary skill in the art to which the present disclosure pertains can fully understand the scope of the present disclosure. The present disclosure will be defined only by the scope of the appended claims.

Terms "first", "second", and the like may be used to describe various constituent elements, but the constituent elements are of course not limited by these terms. These terms are merely used to distinguish one constituent element from another constituent element. Therefore, the first constituent element mentioned hereinafter may, of course, be the second constituent element within the technical spirit of the present disclosure.

Throughout the specification, the same reference numerals denote the same constituent elements.

Respective features of several exemplary embodiments of the present disclosure may be partially or entirely coupled to or combined with each other, and as sufficiently appreciated by those skilled in the art, various technical cooperation and operations may be made, and the respective exemplary embodiments may be carried out independently of each other or carried out together correlatively.

Potential effects, which may be expected by technical features of the present disclosure that are not specifically mentioned in the specification of the present disclosure, are treated as being described in the present specification, and the present embodiments are provided to more completely explain the present disclosure to those skilled in the art. Therefore, the contents illustrated in the drawings may be exaggeratingly expressed in comparison with actual implementation of the present disclosure, and a detailed description of a configuration will be summarized or omitted when it is determined that the description may unnecessarily obscure the subject matter of the present disclosure.

The liquid used herein is collectively called widely liquefied state rather than a state of a solid or gas. That is, the liquid means all states in that an intermolecular distance is short, and kinetic energy is low, but molecules are not strongly bonded like molecules of the solid state, and is used as meaning including all from viscosity-free liquids like water to high viscosity liquids like gel.

The elastic pouch used herein commonly called a bag that is a soft bag that may have or not have a fixed appearance and has a restoring force for returning to an original shape when stretched or expanded due to elastcity while a shape thereof is changed by an external force, and a bag that is a simple soft bag whose shape is changed by an external force because it does not have a fixed appearance.

The container used herein refers to all kinds of containers that are formed of a hard material having a fixed outline such as plastic, glass, metal, paper, or the like, and may be used together with "hard container".

Hereinafter, embodiments of the present disclosure will be described in detail with reference to the accompanying drawings such that those having ordinary knowledge in the art to which the present disclosure pertains can easily carry out the embodiments. However, the present disclosure may be implemented in several different forms, and is not limited to the embodiments described here. In the drawings, in order to clearly describe the present disclosure, portions which are not related to the description of the present disclosure will be omitted, and identical or similar components are denoted by the same reference signs throughout the specification. In addition, a size and thickness of each component indicated in the drawings are arbitrarily shown for convenience of description, and thus the present disclosure is not necessarily restricted by the drawings.

FIG. 3 is a diagram illustrating a container according to an embodiment of the present disclosure, and FIG. 4 is a diagram illustrating a cross section taken along line IV-IV of FIG. 3.

Referring to FIGS. 3 and 4, a container 1 according to the present embodiment stores a liquid content 1, and is characterized in that, in the process of discharging the liquid content 1 to the outside to use a container device 1, the liquid content 1 does not remain on an inner wall of the container device 1.

More specifically, the container device 1 includes an external container 200 in which a storage space 211 is formed, and a pouch assembly 100 that is coupled to the external container 200 and has a pouch unit 110 that is charged with a liquid content in a state in which a part thereof is inserted into the storage space 211 of the container device 1 and thereby a volume thereof is increased. That is, in the container device 1 according to the present embodiment, the liquid content 1 is not charged in the storage space 211 of the external container 200 but is charged in a charging space 112 of the pouch assembly 100, and thereby the liquid content 1 may be used without a remnant to the utmost without the liquid content 1 remaining on an inner wall of the external container 200 during use. Further, in the process of discharging the liquid content 1, a volume of the charging space 112 of the pouch assembly 100 is reduced, and thereby remnant of the liquid content 1 can be suppressed to the utmost.

The external container 200 includes an external container body 210 in which the storage space 211 is formed, and a neck 220 that is disposed on an upper side of the external container body 210, has a smaller diameter than the external container body 210, and has an opening 221 communicating with the storage space 211 in an upper surface thereof. For example, the external container 200 may be formed of material having strength of fixed magnitude for maintaining an outline, such as plastic, metal, paper, glass, or the like. Meanwhile, a configuration in which the external container 200 is formed in a cylinder shape without division between the neck 220 and the external container body 210 is also included in an embodiment of the present disclosure.

In the present embodiment, the configuration in which the storage space 211 of the external container 200 communicates with the outside through the opening 221 and no through-holes other than the opening 221 are formed in the external container 200 has been described. However, a configuration in which other through-holes or a plurality of pores other than the opening 221 are formed in the external container body 210 of the external container 200 is also included in an embodiment of the present disclosure.

The pouch assembly 100 contains a liquid content when coupled to the external container 200. The pouch assembly 100 may include the pouch unit 110 that is formed of an elastic material and has a charging space for charging a liquid therein, and a guide unit 120 into which a part of the pouch unit 110, for example a pouch unit body 111, is fitted and in which a lower surface of another part of the pouch unit 110, for example a lower surface of a pouch-side catch 114, is placed on an upper side thereof.

The pouch unit 110 is formed of, for example, an elastic material, or may be formed of an extensible material, for example a silicone, a natural or synthetic latex rubber, or a polymer material.

In a state in which a part of the pouch unit 110 is fitted into the guide unit 120, the pouch assembly 100 is installed on a side of the opening 221 of the external container 200. That is, the guide unit 120 is disposed between an inner surface of the opening 221 of the external container 200, i.e. an inner surface of the neck 220 and the pouch unit 110.

The guide unit 120 is formed of a material having a higher strength than the pouch unit 110. Therefore, in a process in which a pump for discharging the liquid content 1 to the outside is coupled in a state in which the pouch assembly 100 is installed on the external container 200, a part of the pouch unit 110 can be prevented from being deformed or being entangled toward the opening 221 of the external container 200 by an external force applied to the upper surface of the pouch unit 110.

In addition, by securing a preset size of fluid channels 123 disposed between the pouch unit 110 and the external container 200, the storage space 211 of the external container 200 is made possible to communicate with the outside of the container device 1.

Hereinafter, a configuration of the pouch assembly 100 according to the present embodiment will be described in greater detail.

FIG. 5 is a diagram illustrating the pouch assembly of FIG. 3, and FIGS. 6 and 7 are diagrams illustrating a configuration of the guide unit of FIG. 5.

Referring to FIGS. 5 to 7, the pouch unit 110 of the pouch assembly 100 includes a pouch unit body 111 that has a charging space 112 formed therein and a pouch-side opening 113 communicating with the charging space 112 on one side thereof, a pouch-side catch 114 which is formed on one side of the pouch unit body 111 and whose outer circumference side is outwardly extended further than an outer surface of the pouch unit body 111 in a state in which the pouch-side catch 114 surrounds the pouch-side opening 113, and a selective sealing unit 115 that is disposed on an upper side of the pouch-side catch 114 and selectively opens/closes the pouch-side opening 113.

The selective sealing unit 115 includes a sealing unit body 117 that completely covers the pouch-side opening 113, and a sealing unit edge 116 that is provided on an outer side of the sealing unit body 117 and is fixed to an upper surface of the pouch-side catch 114 after being placed on the pouch-side catch 114. The sealing unit body 117 is formed of an elastic material, and is formed to be openable/closable on the basis of a slit 118 formed in the sealing unit body 117.

Meanwhile, in the present embodiment, the configuration in which the selective sealing unit 115 is placed on the pouch-side catch 114 has been described. However, a configuration in which the pouch-side catch 114 is not separately provided and the selective sealing unit 115 is provided on an end side of the pouch unit body 111 and selectively opens/closes the pouch-side opening 113 is also included in the embodiment of the present disclosure. The selective sealing unit 115 may be fixed to an end side of the pouch unit 110 in such a way that it is formed integrally with the pouch unit 110 or is formed as a separate member distinguished from the pouch unit 110.

The selective sealing unit 115 performs various functions for forming a fluid channel in the pouch unit 110. More specifically, the selective sealing unit 115 may serves as a check valve that can selectively open or close the charging space 112 in the pouch unit 110. The selective sealing unit 115 provides a structure through which a structure such as a nozzle, a pump, or the like can passes while serving as a check valve, and thereby a possibility of mass-productivity can be secured.

Further, in a state in which a pump (a dispenser) for discharging a liquid content charged in the charging space 112 to the outside is installed, a part of the selective sealing unit 115 is entangled toward the charging space 112 and secures a preset space, and thereby the selective sealing unit 115 can prevent closure of a fluid channel which is generated by close contact with an inner surface of the pouch unit 110.

In this case, a lower surface of the sealing unit body 117 is formed to protrude toward the pouch-side opening 113, and is formed in a round shape. A thickness of the sealing unit body 117 is continuously increased from an edge of the sealing unit body 117 toward the center of the sealing unit body 117. Meanwhile, a configuration in which the sealing unit body 117 is formed in a hemispherical shape or in a planar shape is also included in the embodiment of the present disclosure, and the thickness of the sealing unit body 117 may be identically formed from the edge of the sealing unit body 117 toward the center of the sealing unit body 117.

In the present embodiment, the lower surface of the sealing unit body 117 may be formed in a hemispherical shape having a diameter corresponding to a diameter of the pouch-side opening 113, and an upper surface of the sealing unit body 177 is formed in a planar shape. In this case, the slit 118 may be formed in a single line shape having a smaller size than a diameter of the sealing unit body 117. The slit 118 is in symmetry with respect to a central point of the sealing unit body 117.

When the charging space 112 of the pouch unit 110 is charged with a liquid content 1, the selective sealing unit 115 is opened by a charging means 500 for charging the liquid content 1, and the liquid content 1 is charged toward the charging space 112 after the selective sealing unit 115 is opened. When the charging means 500 is removed after the liquid content 1 is completely charged, the slit 118 of the selective sealing unit 115 is closed again by elasticity of the selective sealing unit 115, and the liquid content 1 is prevented from being discharged from the charging space 112 to the outside of the pouch unit 110.

Meanwhile, the guide unit 120 is formed in an annular shape, and is formed of a material having a greater rigidity than the pouch unit 110, for example a material such as a plastic, a metal, or paper.

The guide unit 120 includes a guide unit-side through-hole 125 which is disposed in the center of the guide unit 120 and through which the pouch unit body 111 passes, and fluid channels 123 which are disposed on an outer side of the guide unit 120 relative to the guide unit-side through-hole 125 and some of which are formed in a direction parallel to the guide unit-side through-hole 125.

The guide unit 120 includes a guide unit body 121 that surrounds the guide unit-side through-hole 125 and is formed in an annular shape, and an insertion section that surrounds the guide unit-side through-hole 125, is connected with a lower surface of the guide unit body 121, and includes a plurality of insertion units 122 spaced apart from each other. In this case, some of the fluid channels 123 are disposed between the insertion units 122.

An inner diameter of the guide unit body 121 is larger than that of the guide unit-side through-hole 125, and an outer diameter of the guide unit body 121 is formed to further extend from outer surfaces of the insertion units 122 toward the outside of the guide unit 120.

The insertion units 122 of the insertion section are formed to extend in a direction in which the guide unit-side through-hole 125 is formed, i.e. in a top-down direction, and a part of an upper surface 126 of each insertion unit 122 is exposed to the outside through the guide unit-side through-hole 125. In this case, a lower surface of the pouch-side catch 114 of the pouch unit 110 is placed on the exposed part of the upper surface 126 of each insertion unit, and the pouch unit 110 is caught on the guide unit 120.

An outer diameter of the insertion section including the insertion units 122 corresponds to a diameter of the opening 221 of the external container 200, and when the insertion section is located in the opening 221, outer surfaces of the insertion units 122 of the insertion section come into close contact with an inner surface of the neck 220 of the external container 200. A lower surface 128 of the guide unit body 121 formed to radially extend outward from the insertion section is placed on an end side of the neck 220 of the external container 200.

Meanwhile, one side of each fluid channel 123 is disposed parallel to a lower end 129 of each insertion unit 122, and the other side 124 of each fluid channel 123 is disposed on an outer circumferential surface of the guide unit body 121. The other side 124 of each fluid channel 123 is formed in a shape depressed upward on the basis of the lower surface 128 of the guide unit body 121. Therefore, the fluid channels 123 are formed in a shape bent from one sides thereof toward the other sides thereof. For example, the fluid channels 123 are formed in a shape bent by an angle of about 90°.

The one sides and the other sides 124 of the fluid channels 123, which communicate with one another, communicate with the storage space 211 adjacent to the container and the outside of the container 200, and thereby the fluid channels 123 cause the storage space 211 adjacent to the container and the outside of the container 200 to communicate with each other.

Hereinafter, a process of charging the container device 1 according to an embodiment of the present disclosure with a liquid content 1 will be described in detail.

FIGS. 8 to 11 are diagrams illustrating a process of charging the container of FIG. 3 with a liquid content.

First, referring to FIG. 8, the pouch assembly 100 in which the pouch unit 110 is coupled to the guide unit 120 is installed on the side of the opening 221 of the external container 200, and the charging means 500 is moved toward the selective sealing unit 115 of the pouch assembly 100. When the charging means 500 presses a central side of the selective sealing unit 115 at a pressure over a preset magnitude, the slit 118 of the selective sealing unit 115 is opened, and a part of the charging means 500 is inserted into the charging space 112 of the pouch unit 110.

In this case, a part of a sealing unit body 117 can be rolled toward the container-side opening 221 in the inserting process of the charging means 500.

Next, referring to FIG. 9, a part of the charging means 500 is inserted into the charging space 112 of the pouch unit 110, and an end 510 of the charging means 500 comes into contact with an end of the pouch unit 110. In this state, when the charging means 500 is continuously lowered, the pouch unit 110 is extended toward a lower inner surface of the container 200. When the end of the pouch unit 110 reaches a preset position that does not come into contact with the lower inner surface of the container 200, the movement of the charging means 500 is stopped.

The end of the charging means 500 may be formed in a round shape in order to suppress damage of the contacted pouch unit 110, and the end of the pouch unit 110 may also be formed in a round shape. A high pressure may be applied to a portion at which the end of the charging means 500 comes into direct contact with the pouch unit 100. Therefore, a supply hole 511 formed in the end of the charging means 500 may be formed to extend to a lateral surface of the end of the charging means 500 such that a content can be discharged even if the end of the charging means 500 is pressed by the pouch unit 100. Further, the supply hole 511 may be formed not in the center of the end of the charging means 500 but at an eccentric position in the center.

Next, referring to FIG. 10, the liquid content 1 is supplied to the charging space 112 of the pouch unit 110 through the supply hole 511 formed in the end 510 of the charging means 500 in the state in which the pouch unit 110 is extended. In this case, a discharge pressure at which the charging means 500 supplies the liquid content 1 is greater than a restoring force of the pouch unit 110. Therefore, with the supply of the liquid content 1, the pouch unit 110 may be expanded until its shape corresponds to a shape of the external container, and a volume of the charging space 112 may also be increased. In a state in which the pouch unit 110 is sufficiently extended, the liquid content 1 is supplied to the charging space 112, and thereby the expansion of the pouch unit 110 may lead to a desired volume and shape.

As the volume of the charging space 112 of the pouch unit 110 is increased, a volume of the storage space 210 of the external container 200 in which the charging space 112 of the pouch unit 110 is located is reduced. As the volume of the storage space 210 is reduced, air a of the storage space 210 is discharged to the outside along the fluid channels 123 of the guide unit 120. That is, due to the volume reduction of the storage space 210, the air a of the storage space 210 should be essentially discharged. In the container device 1 according to the present embodiment, the fluid channels 123 for communication between the storage space 210 and the outside are formed, thereby enabling the air a to be smoothly discharged.

In this case, the charging means 500 may be set to a preset speed such that the liquid content 1 adheres to an outer circumferential surface of the charging means 500 to a minimum while supplying the liquid content 1 and in order to suppress interference of the charging of the liquid content 1 due to the volume of the charging means 500. An up speed of the charging means 500 may, for example, be formed at a magnitude at which a height of the liquid content 1 is increased in the charging space 112 of the pouch unit 110.

Meanwhile, the charging means 500 may maintain the extended state as it is until the charging of the content is completed.

Next, referring to FIG. 11, when the charging of the liquid content 1 is completed and the charging means 500 is completely separated from the charging space 112, the selective sealing unit 125 is restored to an original shape again, and the slit 118 of the selective sealing unit 125 is maintained in a closed state. That is, the selective sealing unit 125 formed of an elastic material provides an elastic force toward the slit 118, and thereby the slit 118 is closed, and the liquid content 1 can be inhibited from being discharged to the outside through the slit 118.

The pouch unit body 111 of the container device 1 according to an embodiment of the present disclosure is formed to be long in an up-down direction. When the liquid content is contained in the charging space of the pouch unit body 111, an up-down length of the pouch unit body 111 may be extended to 150% to 1000%, compared to a state in which a separate pressure is not applied to the pouch unit body 111, and a left-right width of the pouch unit body 111 may be extended to 150% to 1000%.

In the state in which the pouch unit body 111 is charged with the liquid content 1, a restoring force of the pouch unit body 111 is greater than a load of the liquid content 1. Therefore, when a configuration for suppressing discharge of the liquid content 1 is not provided to the pouch unit 110, the liquid content 1 is discharged through the pouch-side opening 113 of the pouch unit 110. Therefore, the selective sealing unit 115 of the container device 1 according to the present embodiment inhibits the liquid content 1 from being discharged to the outside through the pouch-side opening 113 of the pouch unit 110 in the state in which the slit 118 is closed, and thereby the process of charging the liquid content 1 can be made to be smoothly performed even if a separate process of blocking a fluid channel that discharges air to the outside of the external container 200 or suctioning air through the fluid channel is not maintained.

Hereinafter, a process of discharging the liquid content 1 to the outside in the container device 1 will be described in detail.

FIGS. 12 and 13 are diagrams illustrating a process of discharging the liquid content to the outside in a state in which the container of FIG. 3 is charged with the liquid content.

First, referring to FIG. 12, the container device 1 according to the present embodiment further includes a pump unit 600 for discharging the liquid content 1, with which the charging space 113 is charged, to the outside.

The pump unit 600 includes a pump unit body 610 that is installed on the neck 220 of the external container 200, a head 620 that is disposed to be moveable up and down relative to the pump unit body 610 in a top-down direction and has a discharge fluid channel 621 formed therein, an elastic means 660 that provides an elastic force against the head 620 in a top-down direction, a support unit 640 on which the elastic means 660 is supported, and a pumping pipe 630, one side of which communicates with the discharge fluid channel 621 and the other side of which passes through the slit 118 of the sealing unit 115 and is disposed in the charging space 112.

When a user presses the head 620 to open the discharge fluid channel 621, the liquid content 1 stored in the charging space 112 can be discharged to the outside through the pumping pipe 630 and the discharge fluid channel 621 by a pressure caused by the pressing of the head 620.

In this case, in proportion to a volume by which the liquid content 1 is discharged to the outside, i.e. in proportion to a volume by which the charging space 112 is reduced, air from the outside is introduced toward the storage space 211 of the external container 200 through the fluid channels 123.

Next, referring to FIG. 13, when most liquid content 1 is discharged and then the liquid content 1 is continuously discharged, a volume of the pouch unit 110 is reduced to a magnitude smaller than a volume of the liquid content 1 before being charged.

The pouch unit 120 has a pouch contact region $Z_2$ with which the inner surface of the pouch unit body 111 comes into contact in a state in which a part of an inner surface of the pouch unit body 111 comes into contact therewith and which is formed around the center of the pouch unit body 111, and a pouch non-contact region $Z_1$ which is formed outside the pouch contact region $Z_2$ and with which the inner surface of the pouch unit body 111 does not come into contact. The other side 631 of the pumping pipe 630 communicates with the pouch non-contact region $Z_1$.

In the pouch contact region $Z_2$, the inner surface of the pouch unit body 111 comes into contact with each other. Thereby, a discharge pressure is not normally applied, and thus the discharge of the remaining liquid content 1 may be restricted.

The pouch unit body 110 of the container device according to the present embodiment is formed of an elastic material in a cylindrical shape. When the volume of the pouch unit body 110 is reduced by outflow of the liquid content 1, the pouch contact region $Z_2$ is formed in the center, and the pouch non-contact region $Z_1$ is formed outside the pouch contact region $Z_2$. The other side 631 of the pumping pipe 630 communicates with the pouch non-contact region $Z_1$. Thereby, the discharge of the remaining liquid content 1 can be made smooth.

That is, when an end of the pumping pipe 630 is inserted into the charging space 112 of the pouch unit 110 through the selective sealing unit 115, a part of the sealing unit body 117 is entangled toward the charging space 112. As a part of the sealing unit body 117 is entangled toward the pouch charging space 112 and a position adjacent to the pouch-side opening 113, a preset size of space by which the pouch non-contact region $Z_1$ is prevented from extending toward the pouch-side opening 113 may be formed.

In the present embodiment, the configuration in which the storage space 211 of the external container 200 communicates with the outside through only the fluid channels 123 in the state in which the pouch assembly 100 is installed on the external container 200 has been described. However, a plurality of holes or pores for communicating with the outside and the storage space 211 may also be formed in the external container body 210 of the external container 200, which is included in an embodiment of the present disclosure. In this case, the pouch assembly 100 may be installed on the external container 200 without a separate guide unit 120.

According to a proposed embodiment, a container in which the liquid content 1 can remain to a minimum can be proposed.

Further, there is an advantage in that a process of charging the liquid content 1 in a container in which a pouch is installed on an external container may be performed in an easy and reliable way.

FIG. 14 is a diagram illustrating a part of a cross section of a container device according to another embodiment of the present disclosure.

The present embodiment only has a difference in a configuration of the selective sealing unit of the container device, and the other configurations are substantially the same as the configurations of the container devices of FIGS. 1 to 13, and thus the following description will be made focusing on the characteristic portions of the present embodiment.

Referring to FIG. 14, an upper surface of the sealing unit body 117 of the container device 1 according to an embodiment of the present disclosure may be depressed toward a lower surface of the sealing unit body 117. For example, a thickness of the sealing unit body 117 may be identically formed from an edge toward the center of the sealing unit body 117.

FIG. 15 is a diagram illustrating a pouch unit of a container device according to another embodiment of the present disclosure.

The present embodiment only has a difference in a configuration of the selective sealing unit of the container device, and the other configurations are substantially the same as the configurations of the container devices of FIGS. 1 to 13, and thus the following description will be made focusing on the characteristic portions of the present embodiment.

Referring to FIG. 15, the slit 118 of the sealing unit 115 according to an embodiment of the present disclosure is disposed in the center of the sealing unit body 117, and may include two or more lines 119 that are radially disposed from the center C of the sealing unit body 117. For example, the slit 118 includes three lines 119, and the three lines 119 are disposed at an angle identical to one another.

FIGS. 16 and 17 are diagrams illustrating a pouch assembly of a container device according to another embodiment of the present disclosure. FIG. 18 is a diagram illustrating a cross section in a state in which the pouch assembly of FIG. 16 is installed on an external container.

The present embodiment only has a difference in a configuration of the pouch assembly, and the other configurations are substantially the same as the configurations of the container devices of FIGS. 1 to 13, and thus the following description will be made focusing on the characteristic portions of the present embodiment.

Referring to FIGS. 16 to 19, the pouch assembly 300 according to the present embodiment includes a pouch unit body 311, a pouch-side catch 314, a selective sealing unit 315, and a plurality of guides 320.

The plurality of guides 320 are disposed at positions adjacent to a pouch-side opening 313 of a pouch unit 310, and are formed integrally with the pouch unit body 311 and the pouch-side catch 314. The plurality of guides 320 are formed of the same elastic material as the pouch unit body 311 and the pouch-side catch 314, and are radially formed to protrude outward from an outer circumferential surface of the pouch unit body 311.

Any one of the guides 320 is separated from the other neighboring guide 320 at a preset distance in a circumferential direction of the pouch-side catch 314. i.e. the circumference of the catch 114, and fluid channels 323 are defined by separated spaces of the guides 320. The plurality of fluid channels 323 are each defined by the outer surface of the pouch unit body 311 and a lower surface of the pouch-side catch 314, and cause the storage space 211 of the external container 200 to communicate with the outside of the container device 1.

Each of the guides 320 includes a first region 321 that is disposed on an outer surface of the pouch unit body 311, and a second region 322 that is formed in a shape bent from the first region 321 and is disposed on the lower surface of the pouch-side catch 314.

An inner surface of the first region 321 coming into contact with the pouch unit body 311 is formed to have a curvature corresponding to that of the outer surface of the pouch unit body 311, and an outer surface of the first region 321 is also formed to have a curvature corresponding to that of the inner surface of the first region 321. A horizontal cross section of the first region 321 is formed in a sector shape, and a thickness of a vertical cross section of the first region 321 is increased from the inner surface of the first region 321 toward the outer surface of the first region 321.

The second region 322 is formed in a sector shape in which a thickness of a vertical cross section thereof is increased from one side of the second region 322 connected to the first region 321 toward the other side of the second region 322 disposed under the edge of the pouch-side catch 314. In this case, the other side of the second region 322 may be formed with the same curvature as the edge of the pouch-side catch 314.

The horizontal cross section of the first region 321 is formed to have a curvature corresponding to that of the outer surface of the pouch unit body 311, and a horizontal cross section of the second region 322 is also formed to have a curvature corresponding to that of the outer surface of the pouch unit body 311. Thereby, the fluid channel 323 between one guide 320 and the neighboring guide 320 is formed to have a uniform width in a process of extending from an end of the first region 321 toward an end of the second region 322.

Meanwhile, the first region 321 and the second region 322 are connected in a state bent at an angle of 90°, and thereby stress is concentrated on a portion at which the first region 321 and the second region 322 are connected. To prevent the first region 321 and the second region 322 from being damaged by the stress, a stress distribution part 324 may be slantly formed at the connected portion between the first region 321 and the second region 322. In a state in which the pouch assembly 300 is installed on the external container 200, a corner of the neck 220, i.e. a container-side opening of the external container 200, may come into contact with the stress distribution part 324.

In a state in which the pouch assembly 300 is coupled to the external container 200, the outer surface of the first region 321 comes into close contact with the inner surface of the external container 200, and the outer surface of the second region 322 comes into close contact with an edge of the container-side opening 221 of the external container 200, i.e. the end of the neck 220.

Therefore, the container-side opening 221 may communicate with the outside only through the fluid channels 323 defined by the guides 320.

Meanwhile, the sealing unit body 117 is depressed toward the container-side opening 221 of the external container 200, and a depression r depressed downward is formed at an upper portion of the sealing unit body 117.

According to a proposed embodiment, the plurality of guides 320 are formed integrally with the pouch assembly 300, and thus there is an advantage that a process of producing the container device 1 is simplified.

Although preferred embodiments of the present disclosure have been described, the present disclosure is not limited to these embodiments. The present disclosure can be carried out in various forms that are variously modified and changed without departing from the claims, the detailed description of the disclosure, and the accompanying drawings, and it goes without saying that these also pertain to the scope of the present disclosure.

While the exemplary embodiments of the present disclosure have been described above, the present disclosure is not limited thereto, and various modifications can be made and carried out within the scope of the claims, the detailed description of the invention, and the accompanying drawings, and also fall within the scope of the present disclosure.

MODE FOR INVENTION

The modes for carrying out the disclosure haven been described along with the above best mode for carrying out the disclosure.

INDUSTRIAL APPLICABILITY

The pouch assembly and the container device using the same according to the present disclosure are provided, and have a repetitive possibility and an industrial applicability, for example, in a container in which a content is stored.

The invention claimed is:

1. A pouch assembly for storing a liquid comprising a pouch unit which is formed of an elastic material and in which a charging space for charging the liquid is formed, wherein the pouch unit includes a pouch unit body in which the charging space and a pouch-side opening communicating with the charging space on one side thereof are formed, a pouch-side catch which is formed on one side of the pouch unit body and in which an outer circumferential side thereof in a state in which the pouch-side catch surrounds the pouch-side opening further extends outward from an outer surface side of the pouch unit body, and a selective sealing unit which is disposed at an upper side of the pouch-side catch and selectively opens/closes the pouch-side opening, and further comprising a plurality of guides that are disposed on an outer circumferential surface of the pouch unit body and are formed to protrude in a radial shape, wherein each guide includes a first region that comes into contact with an outer circumferential surface of the pouch unit body, and a second region that is formed in a shape bent from the first region and is disposed on a lower surface of the pouch-side catch, wherein a plurality of fluid channels is formed along an outer surface of the pouch unit body and a lower surface of the pouch-side catch, and wherein each fluid channel of the plurality of fluid channels is disposed between one guide and the neighboring other guide.

2. The pouch assembly of claim 1, wherein:

the selective sealing unit includes a sealing unit body which completely covers the pouchside opening, and a selective sealing unit edge which is provided outside the sealing unit body and is fixed to an upper surface of the pouch-side catch in a state placed on the pouch-side catch; and the sealing unit body is formed of an elastic material and enables opening/closing on the basis of a slit formed in the sealing unit body.

3. The pouch assembly of claim 2, wherein a lower surface of the sealing unit body is formed to protrude toward the pouch-side opening.

4. The pouch assembly of claim 3, wherein the lower surface of the sealing unit body is formed to protrude in a round shape.

5. The pouch assembly of claim 3, wherein a thickness of the sealing unit body is continuously increased from an edge of the sealing unit body toward the center of the sealing unit body.

6. The pouch assembly of claim 3, wherein an upper surface of the sealing unit body is depressed toward the lower surface of the sealing unit body.

7. The pouch assembly of claim 2, wherein the slit is formed in a single line disposed in the center of the sealing unit body.

8. The pouch assembly of claim 2, wherein the slit is disposed in the center of the sealing unit body and includes two or more lines that are radially disposed from the center of the sealing unit body.

9. The pouch assembly of claim 1, further comprising a guide unit which the pouch unit body approaches and in which a lower surface of the pouch-side catch of the pouch unit is placed on an upper side thereof.

10. The pouch assembly of claim 9, wherein the guide unit includes a through-hole which is formed in an annular shape, is disposed in the center of the guide unit, and through which the pouch unit body passes, and fluid channels which are disposed on an outer side of the guide unit relative to the through-hole and some of which are formed in a direction parallel to the through-hole.

11. The pouch assembly of claim 10, wherein:

the guide unit includes a guide unit body that surrounds the through-hole and is formed in an annular shape, and an insertion section that surrounds the through-hole, is connected with a lower surface of the guide unit body, and includes a plurality of insertion units spaced apart from each other;

an inner diameter of the guide unit body is larger than that of the through-hole, and an outer diameter of the guide unit body is formed to further extend from outer surfaces of the insertion units toward the outside of the guide unit;

the insertion units of the insertion section are formed to extend in a direction in which the through-hole is formed, a part of an upper surface of each insertion unit is exposed to the outside through the through-hole, and a lower surface of the pouch-side catch of the pouch unit is placed on the exposed part of the upper surface of each insertion unit; and some of the fluid channels are disposed between the insertion units.

12. The pouch assembly of claim 11, wherein:

one side of each fluid channel is disposed parallel to a lower end of each insertion unit;

the other side of each fluid channel is disposed on an outer circumferential surface of the guide unit body; and each fluid channel is formed in a shape bent from one side of each fluid channel toward the other side of each fluid channel.

13. The pouch assembly of claim 1, wherein:

horizontal cross sections of the first region and the second region are formed to have curvatures corresponding to those of the pouch unit body and the pouch-side catch;

the first region and the second region are formed in a shape bent from each other; and a stress distribution part formed slantly is disposed at a portion at which the first region and the second region are mutually connected.

14. A container device for storing a liquid comprising:

an external container in which a storage space is formed and which includes a container-side opening communicating with the storage space; and a pouch unit which is formed of an elastic material and in which a charging space for charging the liquid is formed, the pouch unit including a pouch assembly, a part of which is inserted into the storage space through the container-side opening, wherein the pouch unit includes a pouch unit body in which the charging space and a pouch-side opening communicating with the charging space on one side thereof are formed, a pouch-side catch which is formed on one side of the pouch unit body and in which an outer circumferential side thereof in a state in which the pouch-side catch surrounds the pouch-side opening further extends outward from an outer surface side of the pouch unit body, and a selective sealing unit which is disposed at an upper side of the pouch-side catch and selectively opens/closes the pouch-side opening, and the pouch-side catch and the selective sealing unit are disposed adjacent to the container-side opening, further comprising a plurality of guides that are disposed on an outer circumferential surface of the pouch unit body and are formed to protrude in a radial shape, wherein each guide includes a first region that comes into contact with an outer circumferential surface of the pouch unit body, and a second region that is formed to be bent from the first region and is disposed on a lower surface of the pouch-side catch, and wherein a plurality of fluid channels is formed along an outer surface of the pouch unit body and a lower surface of the pouch-side catch, and wherein each fluid channel of the plurality of fluid channels is disposed between one guide and the neighboring other guide.

15. The container device of claim 14, wherein:

the selective sealing unit includes a sealing unit body which completely covers the pouch-side opening, and a selective sealing unit edge which is provided outside the sealing unit body and is fixed to an upper surface of the pouch-side catch in a state placed on the pouch-side catch; and the sealing unit body is formed of an elastic material and enables opening/closing on the basis of a slit formed in the sealing unit body.

16. The container device of claim 15, further comprising a pump unit configured to discharge a liquid content charged in the charging space to the outside, wherein a part of a pumping pipe of the pump unit passes through the slit of the sealing unit and is disposed in the charging space, the pouch unit has a pouch contact region with which the inner surface of the pouch unit body comes into contact in a state in which parts of an inner surface of the pouch unit body come into contact therewith and which is formed around the center of the pouch unit body, and a pouch non-contact region which is formed outside the pouch contact region and with which the inner surface of the pouch unit body does not come into contact, and the pumping pipe communicates with the pouch non-contact region.

17. The container device of claim 14, wherein:

the pouch assembly further includes a guide unit which the pouch unit body approaches and in which a lower surface of the pouch-side catch of the pouch unit is placed on an upper side thereof;

the guide unit includes a through-hole which is formed in an annular shape and in which the pouch unit body passes through the center thereof, and fluid channels which are disposed on an outer side of the guide unit relative to the through-hole and some of which are formed in a direction parallel to the through-hole; and one sides and the other sides of the fluid channels, which communicate with one another, communicate with the container-side storage space and the outside of the external container, and thus the fluid channels cause the container-side storage space and the outside of the external container to communicate with each other.

18. The container device of claim 14, wherein:

the pouch unit body is formed to extend long in a top-down direction; and when a liquid content is stored in the charging space of the pouch unit body, in comparison with a state in which a separate pressure is not applied to the pouch unit body, a top-down length of the pouch unit body is increased from 150% to 1000%, and a left-right width of the pouch unit body is increasable from 150% to 1000%, and in a state in which the liquid content is charged in the pouch unit body, a restoring force of the pouch unit body is greater than a load of the liquid content; and in a state in which a slit is closed, the selective sealing unit inhibits the liquid content from being discharged to the outside through the pouch-side opening of the pouch unit.

19. The container device of claim 14, wherein horizontal cross sections of the first region and the second region are formed to have curvatures corresponding to those of the pouch unit body and the pouch-side catch;

the first region and the second region are formed in a shape bent from each other;

a stress distribution part formed slantly is disposed at a portion at which the first region and the second region are mutually connected; and the stress distribution part comes into contact with an edge of the container-side opening of the external container.

* * * * *